US010618761B1

(12) United States Patent
Staley et al.

(10) Patent No.: US 10,618,761 B1
(45) **Date of Patent: *Apr. 14, 2020**

(54) DEVICE FOR ROLLING UP AND UNROLLING A FLOATING MAT

(71) Applicants: Thomas G. Staley, Charter Oak, IA (US); Paul J. Assman, Denison, IA (US)

(72) Inventors: Thomas G. Staley, Charter Oak, IA (US); Paul J. Assman, Denison, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/569,004

(22) Filed: Sep. 12, 2019

Related U.S. Application Data

(63) Continuation-in-part of application No. 16/156,108, filed on Oct. 10, 2018.

(51) Int. Cl.
*B65H 75/44* (2006.01)
*B65H 18/08* (2006.01)
*B63B 34/00* (2020.01)

(52) U.S. Cl.
CPC ..... *B65H 18/08* (2013.01); *B63B 34/00* (2020.02)

(58) Field of Classification Search
CPC B65H 75/44; B65H 75/4481; B65H 75/4492; B65H 18/08; B63B 35/73
See application file for complete search history.

(56) References Cited

U.S. PATENT DOCUMENTS 5,810,281 A * 9/1998 Kole ..... B65H 75/22 242/532.6
6,386,476 B1 * 5/2002 Adleman, Jr. ..... E04G 23/006 156/763
2004/0108404 A1 * 6/2004 Wiermaa ..... B65H 18/10 242/532.6
2018/0251334 A1 * 9/2018 Behrendt ..... B65H 75/22

* cited by examiner

*Primary Examiner* — Sang K Kim
(74) *Attorney, Agent, or Firm* — Dennis L. Thomte; Thomte Patent Law Office LLC

(57) ABSTRACT

A device for rolling up and unrolling a floating mat. The device of the invention includes an elongated hollow cylinder having a first end and a second end. The cylinder has an elongated slot formed therein which extends between the ends thereof. A mat retainer bar is positioned in the cylinder. One end of the mat extends inwardly through the slot in the cylinder and is secured to the mat retainer bar. End cap assemblies are secured to the ends of the cylinder and have a lever secured thereto. The mat may be rolled up on the cylinder or unrolled from the cylinder by rotating the cylinder by way of the levers. The levers may be pivotally moved with respect to the end cap assemblies so that they may be stowed in the end cap assemblies and the ends of the cylinder.

11 Claims, 12 Drawing Sheets

DEVICE FOR ROLLING UP AND UNROLLING A FLOATING MAT

CROSS REFERENCE TO RELATED APPLICATION

This is a Continuation-In-Part Application of application Ser. No. 16/156,108 filed Oct. 10, 2018, entitled DEVICE FOR ROLLING UP AND UNROLLING A FLOATING MAT.

BACKGROUND OF THE INVENTION

Field of the Invention

This invention relates to a device for rolling up and unrolling a floating mat. More particularly, this invention relates to a device for rolling up, storing, carrying and unrolling a floating mat.

Description of the Related Art

Floating mats have become very popular in recent years. The floating mats are generally manufactured from a foam product and have lengths ranging from 15 to 18 feet, widths from 5 to 6 feet and have thicknesses from 1⅜$^{th}$ inches to 2 inches. The floating mats are used for water recreation. Most often they are carried on boats to various locations on lakes where the boats are anchored and the mats are unrolled onto the surface of the water to be enjoyed by swimmers. In some cases, the mats are simply unrolled from the end of a dock where they are enjoyed as well. The challenge of the floating mats is that when it is time to wrap up a day of leisure on the lake they have to be rolled up and stored on the boat. This can be somewhat of a challenge.

The prior art is replete with different types for rolling up the floating mats for storage or transport. Some of the prior art products are manufactured from metal although boat owners do not like to use metal products on their expensive boats due to the potential for damage to the upholstery and the fiberglass or aluminum of the boat. Some of the prior art devices for rolling up the floating mats require that they be assembled and disassembled each time they are used. Further, the prior art devices for rolling up the floating mats may be difficult to not only roll up the floating mats but also to pick up and carry the rolled up mat.

The invention of the co-pending patent application represents an improvement in the art. The instant invention represents a further improvement in the art.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A device is described for rolling up and unrolling a floating mat, having a first end, a second end, a first side, a second side, a top surface and a bottom surface. The device of the invention includes an elongated hollow cylinder having a first end, a second end, and an outer surface. Preferably, the hollow cylinder is comprised of a plastic material. The cylinder includes an elongated slot, having first and second ends, which is formed in the outer surface thereof which extends between the first and second ends of the cylinder. An elongated mat retainer is provided having a first end, a second end, a first side and a second side. The mat retainer has an elongated slot formed therein which extends inwardly thereinto from one side thereof. The slot of the mat retainer is configured to receive the first end of the floating mat therein. The first end of the floating mat is secured to the mat retainer by a plurality of bolts or the like.

The mat retainer and the first end of the floating mat are positioned in the cylinder by slidably extending the mat retainer and the first end of the floating mat attached thereto into one end of the cylinder with the floating mat extending outwardly through the slot in the cylinder. A first end cap assembly is selectively secured to the first end of the cylinder and a second end cap assembly is selectively secured to the second end of the cylinder.

The first end cap assembly includes a generally cylindrical body member having an inner end, an outer end, an upper end, a lower end, a first side and a second side.

The body member includes a reduced diameter portion which is inserted into the first end of the cylinder. The body member also includes an outer end portion having an inner end, an outer end, a first side and a second side. A handle is secured to the outer end of the outer end portion. The body member has an elongated and horizontally disposed bore, having an inner end and an outer end, formed therein which extends between the inner end of the body member and the outer end of the body member. The body member also has a vertically disposed bore formed in the outer end portion of the body member which extends between the lower and upper ends of the outer end portion. The vertically disposed bore intersects the horizontally disposed bore so as to be in communication therewith. A slot is formed in the outer end portion which extends downwardly into the outer end portion from the upper end thereof. The slot communicates with the vertically disposed bore and the horizontally disposed bore.

An elongated first pin, having an outer end and an inner end, extends inwardly into the first side of the outer end portion with the inner end of the first pin protruding intro the horizontally disposed bore and the vertically disposed bore. An elongated second pin, having an outer end and an inner end, extends inwardly into the second side of the outer end portion with the inner end of the second pin protruding into the horizontally disposed bore and the vertically disposed bore. The inner ends of the first and second pins are spaced-apart and are oppositely disposed.

The outer end portion of the body member has an arcuate positioning member which extends from the inner end of the outer end portion and which is configured to be received in the first end of the slot of the cylinder when the inner end portion is inserted into the first end of the cylinder.

The device of this invention also includes an elongated lever having a first end, a second end, a first side and a second side. The first side of the lever includes an elongated first groove formed therein. The second side of the lever includes an elongated second groove formed therein. The lever is selectively movable between a first grasping or gripping position wherein the lever is transversely disposed with respect to the body member and a second stowed position. When the lever is positioned in the grasping or gripping position, the lever may be selectively slidably moved in the vertically disposed bore. When the lever is positioned in the stowed position, the lever is positioned in the horizontally disposed bore and the interior of the first end of the cylinder. In each of the positions, the inner ends of the first and second pins are received in said first and second grooves of the lever respectively. Means is also provided for maintaining the lever in the stowed position.

The second end cap assembly is identical to the first end cap assembly except for the positioning member of the second end cap assembly being located on the opposite side of the inner end portion.

It is therefore a principal object of the invention to provide an improved device for rolling up and unrolling a floating mat.

A further object of the invention is to provide a device of the type described which includes an elongated hollow cylinder which is comprised of a plastic material with one end of the floating mat extending outwardly through a slot in the side of the container and maintained therein by a mat retainer.

It is a further object of the invention to provide a device of the type described which is easy to use and which enables a floating mat to be easily rolled up around an elongated hollow cylinder and easily carried.

A further object of the invention is to provide a device of the type described which does not require disassembly and assembly between uses.

A further object of the invention is to provide a device of the type described which includes a lever which is selectively movable between a grasping position and a stowed position.

A further object of the invention is to provide a device of the type described which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
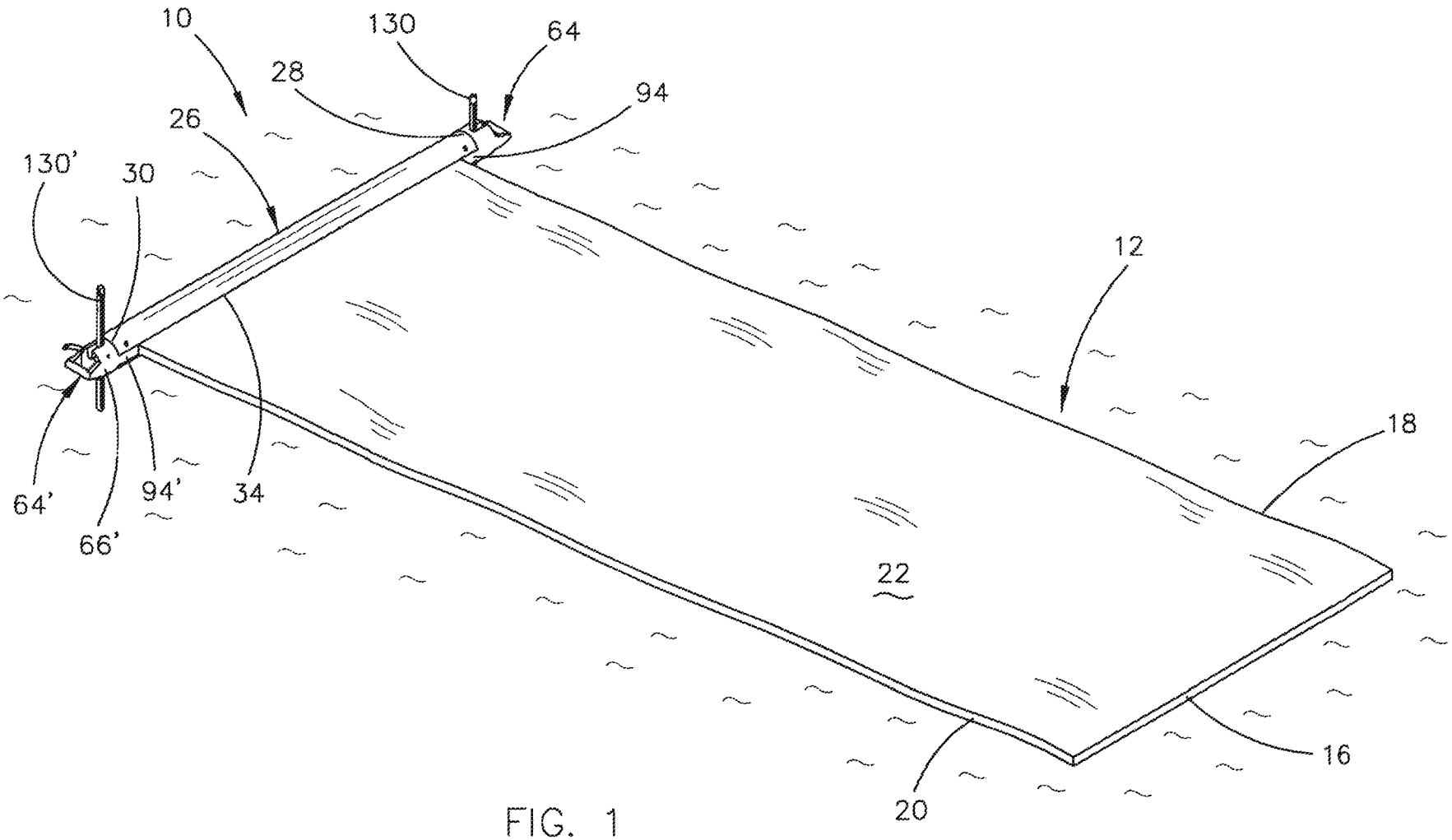
FIG. 1 is a perspective view illustrating the device of this invention secured to one end of a floating mat.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The device for rolling-up, storing, unrolling and securing a floating mat thereto is designated by the reference numeral 10. The numeral 12 refers to a conventional floating mat which is comprised of a foam product such as polyethylene or the like and which may have a length ranging from 15 to 18 feet, widths from 5 to 6 feet, a thickness of 1⅜ths inches to 2 inches. For purposes of description, mat 12 will be described as having a first end 14, a second end 16, a first side 18, a second side 20, an upper side 22 and a lower side 24.

Device 10 includes an elongated hollow cylinder 26 which is comprised of a plastic material such as PVC. Cylinder 26 has a first end 28, a second end 30, and a cylindrical wall 32. Wall 32 has an elongated slot 34 formed therein which extends between ends 28 and 30.

The numeral 36 refers to an elongated mat retainer bar having a first end 38 and a second end 40. The retainer bar 36 has the same length as the width of the floating mat involved. Retainer bar 36 is preferably comprised of a plastic material. Retainer bar 36 has a horizontally disposed and generally U-shaped body portion 42 which includes an upper wall 44, a lower wall 46, and a side wall 48 which defines a channel 50, and curved wings 52 and 54 which extend from upper wall 44 and lower wall 46 respectively. Upper wall 44 has a plurality of spaced-apart bolt holes 56 formed therein. Lower wall 46 has a plurality of spaced-apart bolt holes 58 formed therein which register with the bolt holes 56.

As seen, the inner end 14 of mat 12 is received in the channel 50 of the mat retainer bar 36. The inner end 14 of mat 12 is maintained in the channel 50 by a plurality of bolts 60, which are preferably plastic, which extend through the holes 56, through holes 57 in mat 12 and outwardly through holes 58 of retainer bar 36. Nuts 62 are threadably secured to the lower ends of the bolts 60.

Figure 2:
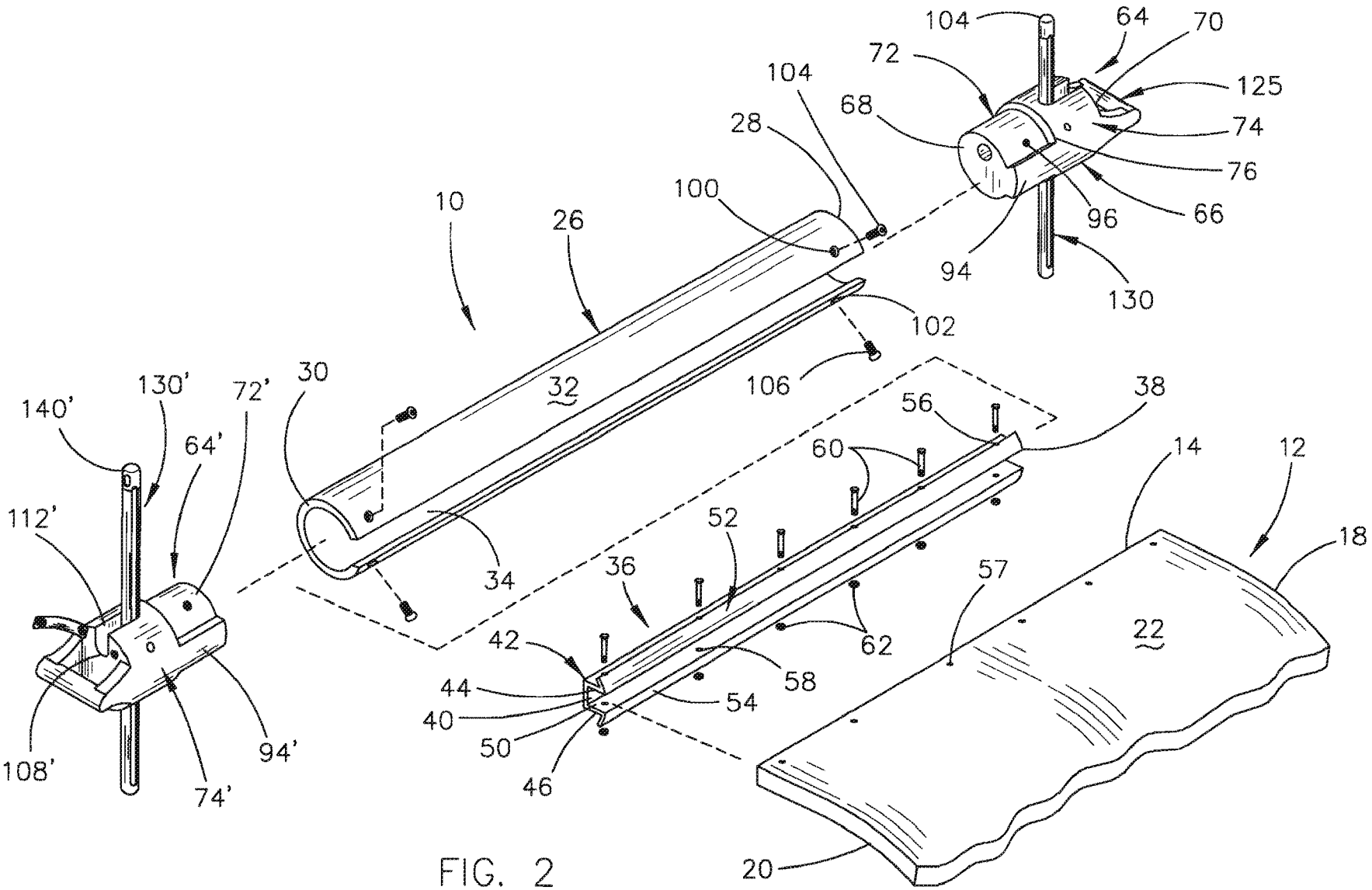
FIG. 2 is a partial exploded perspective view of the device of this invention and its relationship to one end of a floating mat.
Figure 3:
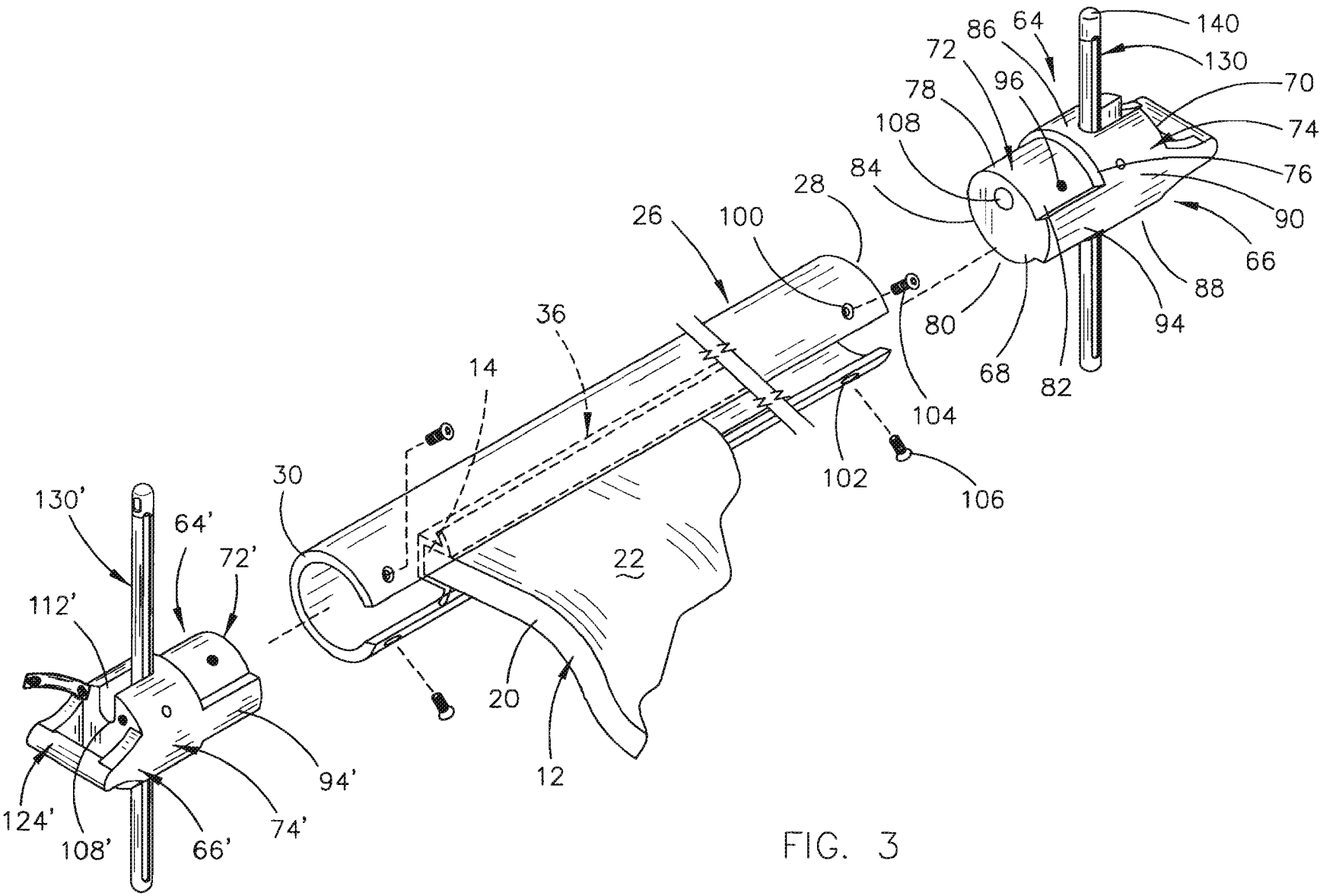
FIG. 3 is a further partial exploded perspective view of the device of this invention and its relationship to one end of a floating mat.
Figure 4:
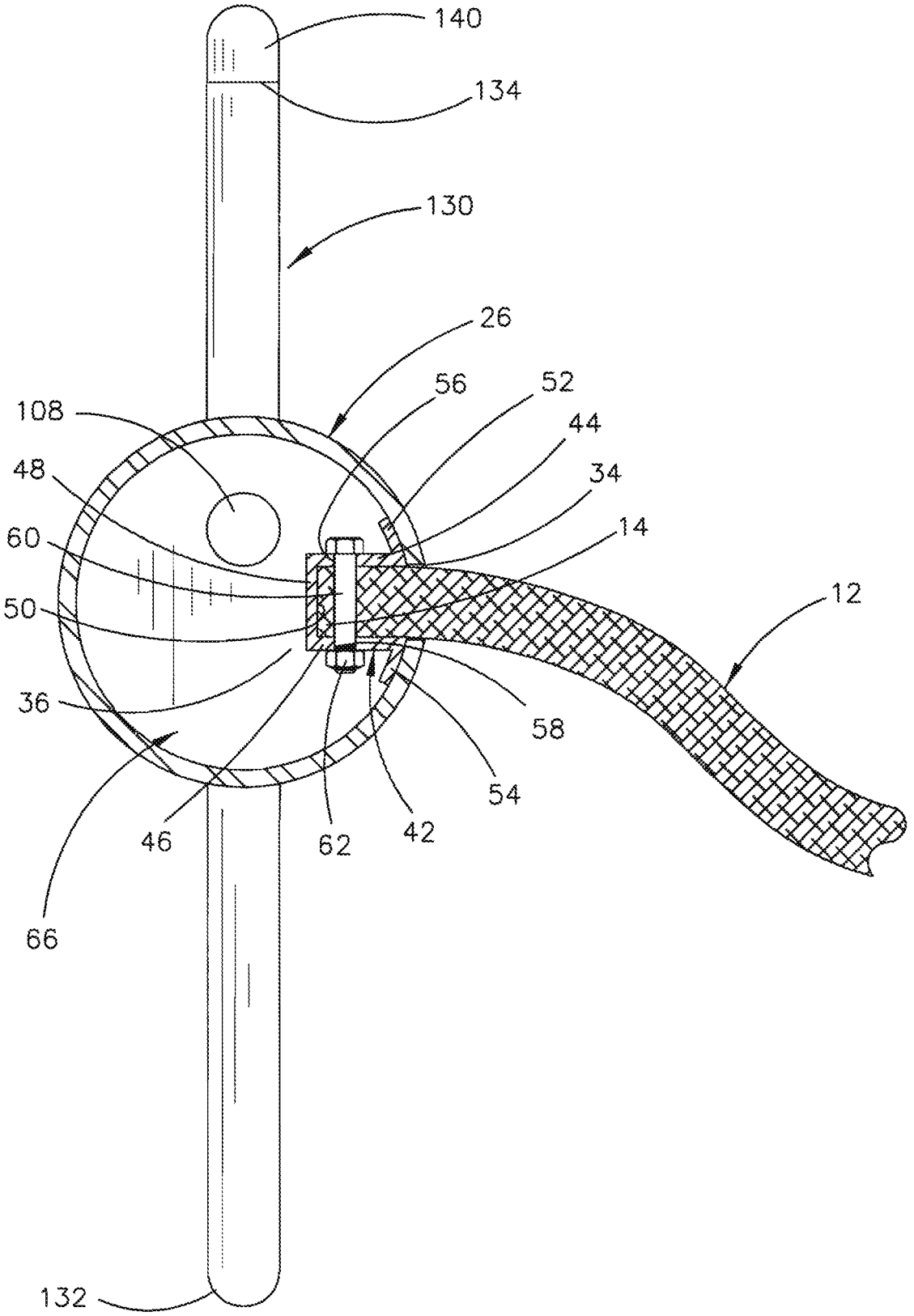
FIG. 4 is a partial sectional view of this invention having one end of a floating mat secured thereto.

The numeral 64 refers to an end cap assembly which is secured to end 28 of cylinder 26 as will now be described in detail. For purposes of description only, end cap assembly 64 will be described as being in the position shown in FIGS. 2 and 3 wherein it is about to be secured to end 28 of cylinder 26.

End cap assembly 64 includes a solid body member 66 having an inner end 68 and an outer end 70. Body member 66 is preferably comprised of plastic such as PVC. Body member 66 includes a cylindrical inner end portion 72 and a cylindrical outer end portion 74. Outer end portion 74 has a greater diameter than inner end portion 72. A shoulder 76 is defined at the inner end of outer end portion 74 and the outer end of inner end portion 72.

Figure 11B:
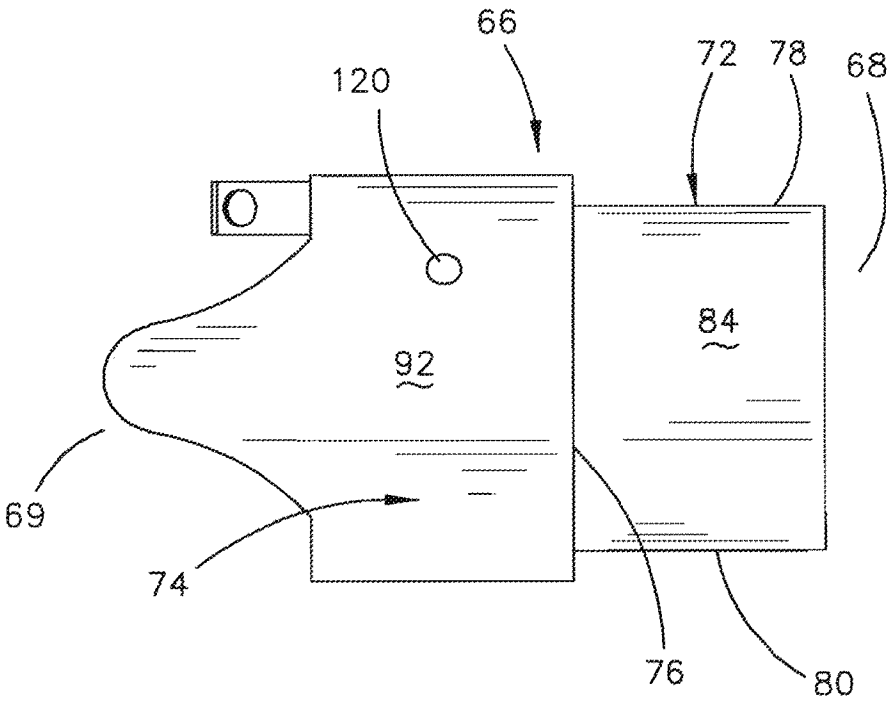
FIG. 11B is an opposite side view of the end cap assembly of FIG. 11A.
Figure 11A:
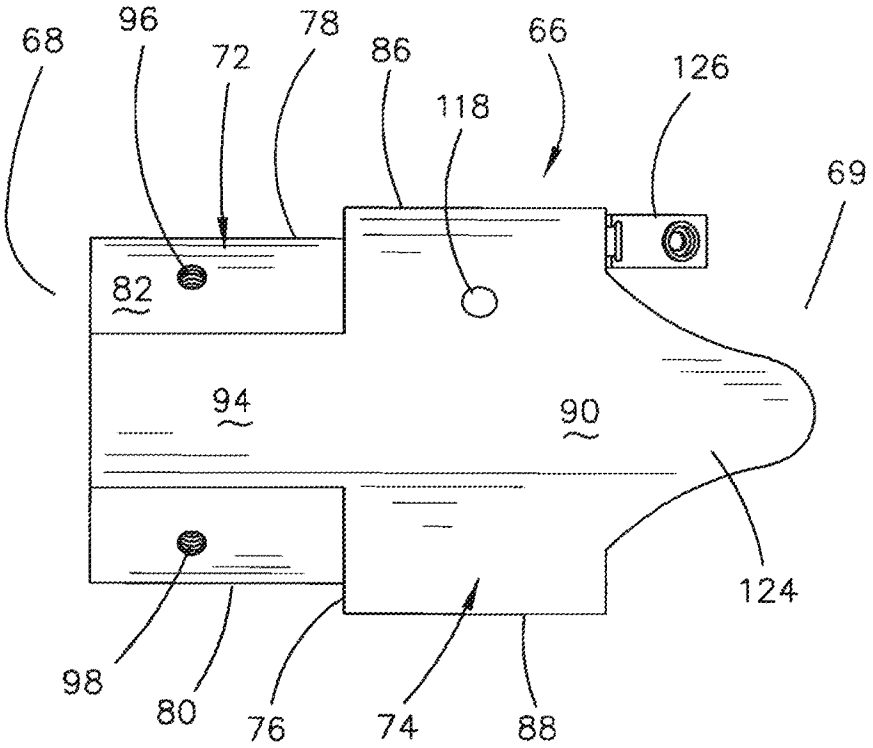
FIG. 11A is a side view of the first end cap assembly of this invention which is secured to the right end of the cylinder of this invention.
Figure 12B:
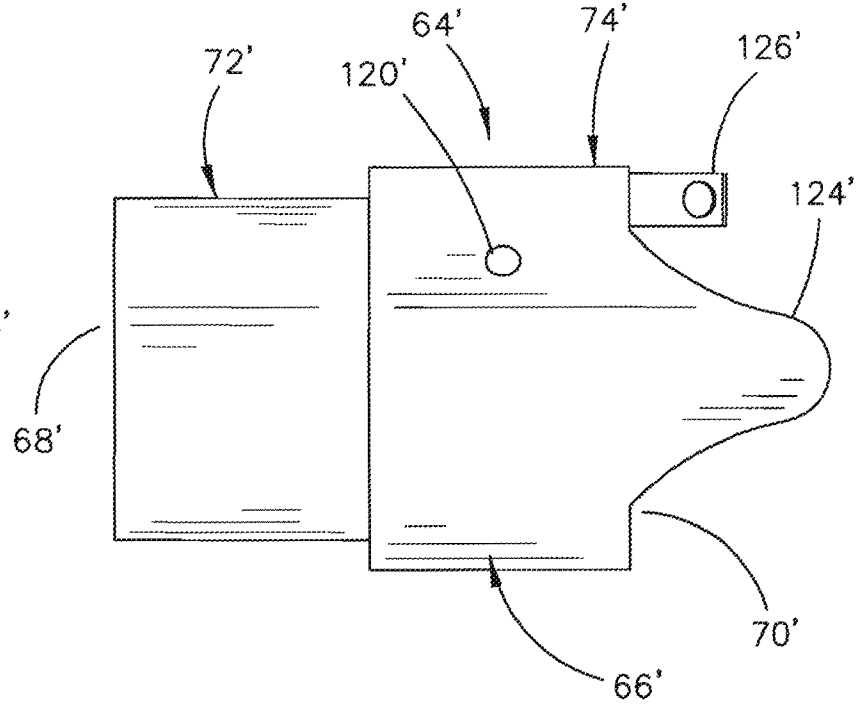
FIG. 12B is an opposite side view of the end cap assembly of FIG. 12A.
Figure 12A:
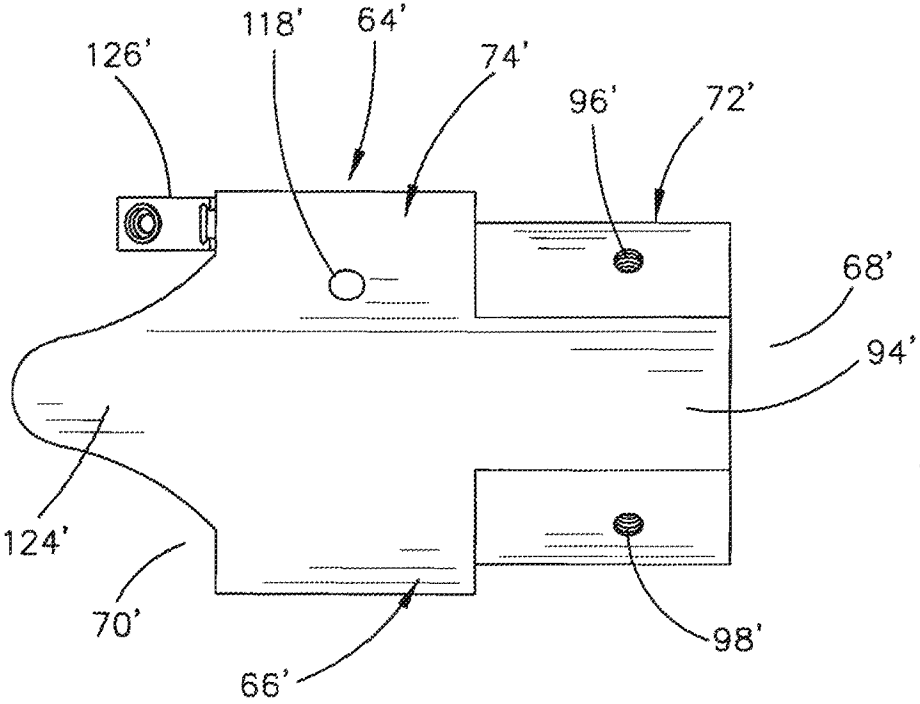
FIG. 12A is a side view of the second end cap assembly of this invention which is secured to the left end of the cylinder of this invention.
Figure 13:
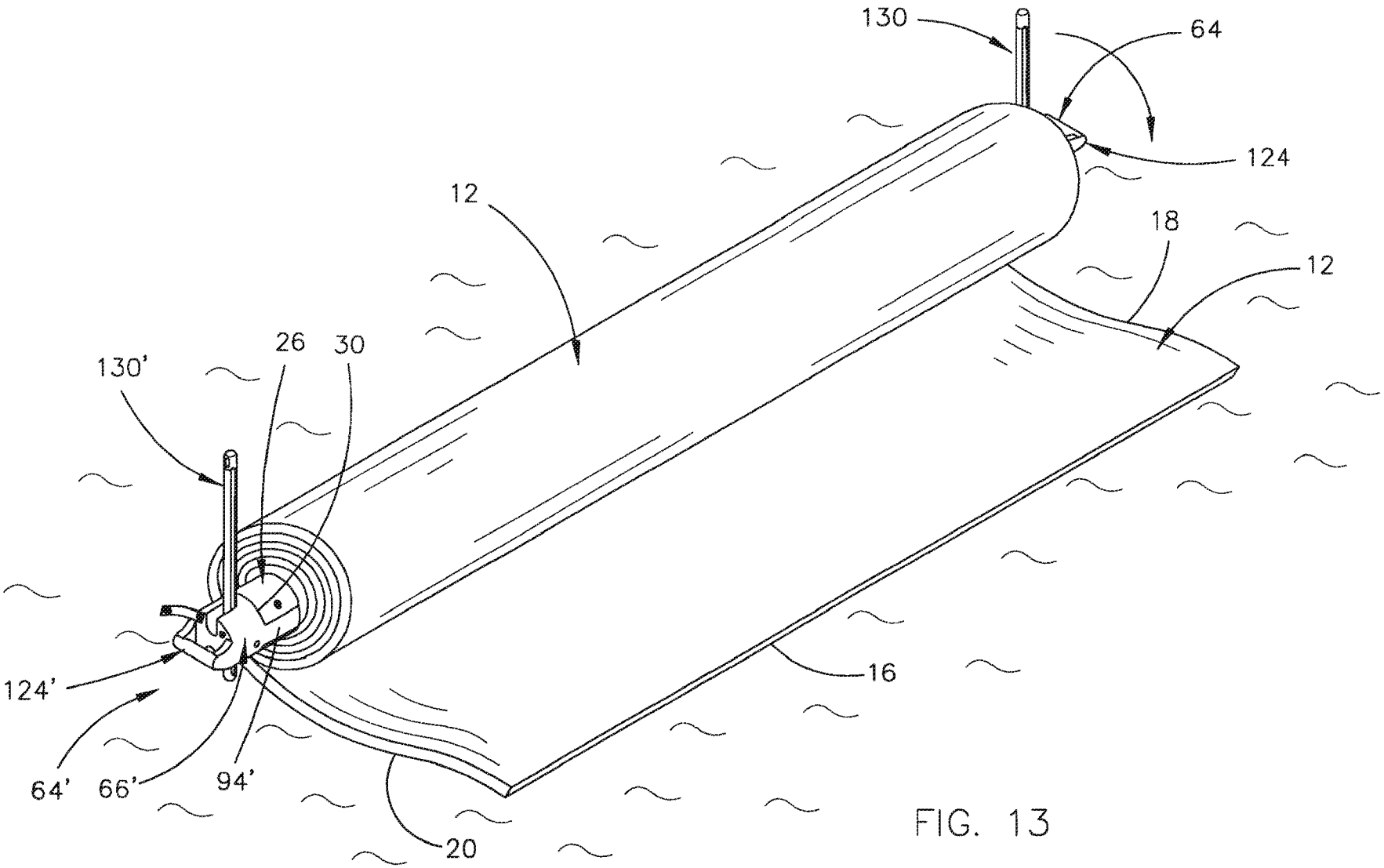
FIG. 13 is a perspective view illustrating a floating mat being wound upon the device of this invention.

Inner end portion 72 will be described as having an upper end 78, a lower end 80, a first or left side 82 and a second or right side 84 as viewed from the outer end of end cap assembly 64. Outer end portion 74 will be described as having an upper end 86, a lower end 88, a first or left side 90 and a second or right side 92 as viewed from the outer end of end cap assembly 64. The side views of FIGS. 11A and 11B more fully illustrate the configuration of end cap assembly 64 and body member 66.

Outer end portion 74 includes a generally rectangular and curved guide portion or positioning member 94 which extends inwardly therefrom at the left side 82 of inner end portion 72. As seen, guide portion 94 is configured so as to be received in slot 34 at end 28 of cylinder 26. Guide portion 94 projects from the exterior surface of inner end portion 72 and has a thickness equal to the thickness of wall 32 of cylinder 26.

Inner end portion 72 includes a pair of radially spaced-apart threaded openings 96 and 98 formed therein which are adapted to be aligned with the radially spaced-apart bolt openings 100 and 102 formed in cylinder 26 at end 28 thereof when end cap assembly 64 is secured to end 28 of cylinder 26. Bolts 104 and 106 are configured to be extended through bolt openings 100 and 102 respectively and threadably secured into internally threaded openings 96 and 98 respectively in inner end portion 72 of body member 66 when end cap assembly 64 is secured to cylinder 26.

Body member 66 has an elongated and horizontally disposed bore 108 formed therein which extends inwardly from the inner end 68 of body member 66 to the outer end 70 thereof. As seen, the bore 108 is offset upwardly from the center of body member 66. Body member 66 also has a vertically disposed bore 110 formed therein which extends upwardly from the lower end 88 of outer end portion 74 to the upper end 86 of outer end portion 74 and which intersects bore 108 so as to be in communication therewith. Body member 66 also has a slot 112, having an inner end 114 and an outer end 116, formed therein which extends downwardly into body member 66 at the outer end of body member 66. The inner end 114 of slot 112 communicates with bore 110. The lower end of slot 112 communicates with bore 108.

Outer end portion 74 of body member 66 has pin openings 118 and 120 extending into outer end portion 74 from the sides of outer end portion 74. Pin openings 118 and 120 are radially spaced apart. The inner ends of pin openings 118 and 120 are positioned just above the upper end of bore 110. Pins 121 and 122 are mounted in pin openings 118 and 120 respectively so that the inner ends of pins 121 and 122 protrude inwardly into body member 66 at the intersection of bore 108 and 110.

Body member 66 has a handle 124 at its outer end which is positioned below the outer end of bore 108. The numeral 126 refers to a flexible strap having one end secured to the outer end 70 of body member 66. The outer end of strap 126 may be secured to a snap 128 in conventional fashion. When strap 126 is secured in place, it extends across the outer ends of bore 108 and slot 112.

The numeral 130 refers to an elongated lever having ends 132 and 134. Lever 130 has a pair of oppositely disposed grooves 136 and 138 formed therein. As seen, the grooves 136 and 138 terminate inwardly of end 132. The grooves 136 and 138 go to the end 134 of lever 130. The numeral 140 refers to a cap which is snap-fitted to end 134 of lever 130. As seen, cap 140 has grooves 142 and 144 formed therein which register with grooves 136 and 138 respectively when cap 140 is secured to lever 130.

In some cases, when the device 10 is being shipped from the factory, the lever 130 will be separated from body member 66 for packaging and shipment purposes. In that case, the lever 130 must be attached to body member 66. Since the inner ends of pins 121 and 122 protrude into bores 108 and 110, the lever 130 cannot simply be inserted into either of those bores since the grooves 134 and 136 do not extend to the ends of lever 130. For that reason, the cap 140 is provided. Cap 140 is removed from end 134 of lever 130 which exposes the ends of grooves 134 and 136 at end 134 of lever 130. End 134 of lever 130 is then inserted into the lower end of bore 110 and slidably moved upwardly until the grooves 134 and 136 register with pins 121 and 122 with the inner ends of pins 121 and 122 being received in grooves 134 and 136 respectively. The lever 130 is slidably moved inwardly with respect to body member 66 until end 134 of lever 130 is exposed. Cap 140 is then secured to end 134 of lever 130 with the grooves 142 and 144 of cap 140 registering with the grooves 134 and 136 of lever 130.

Figure 5:
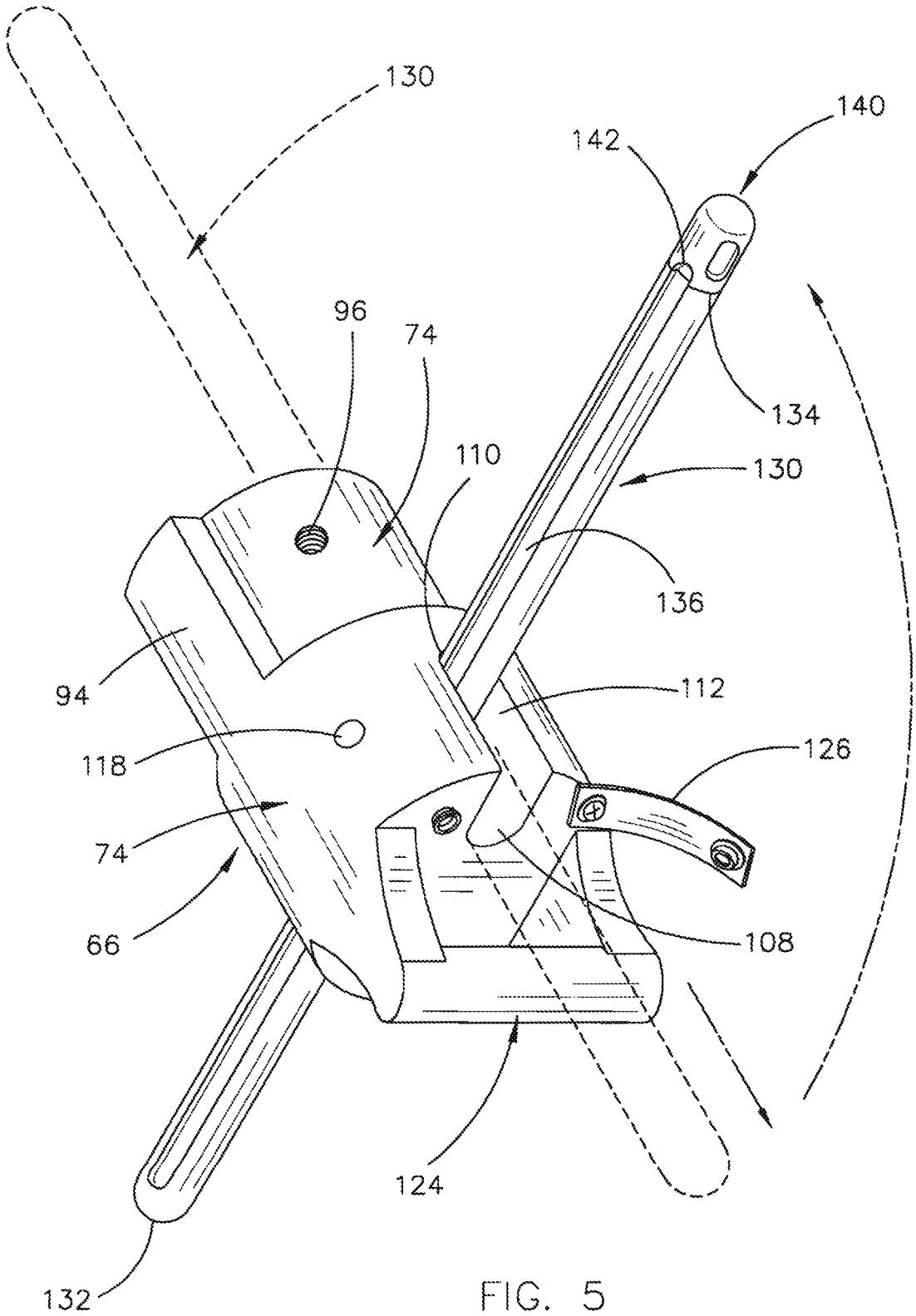
FIG. 5 is a perspective view of one of the end cap assemblies of this invention which illustrates the associated lever being in a transverse grasping position with respect to the body member of the device of this invention and with the broken lines illustrating the lever thereof being moved to a stowed position.
Figure 7:
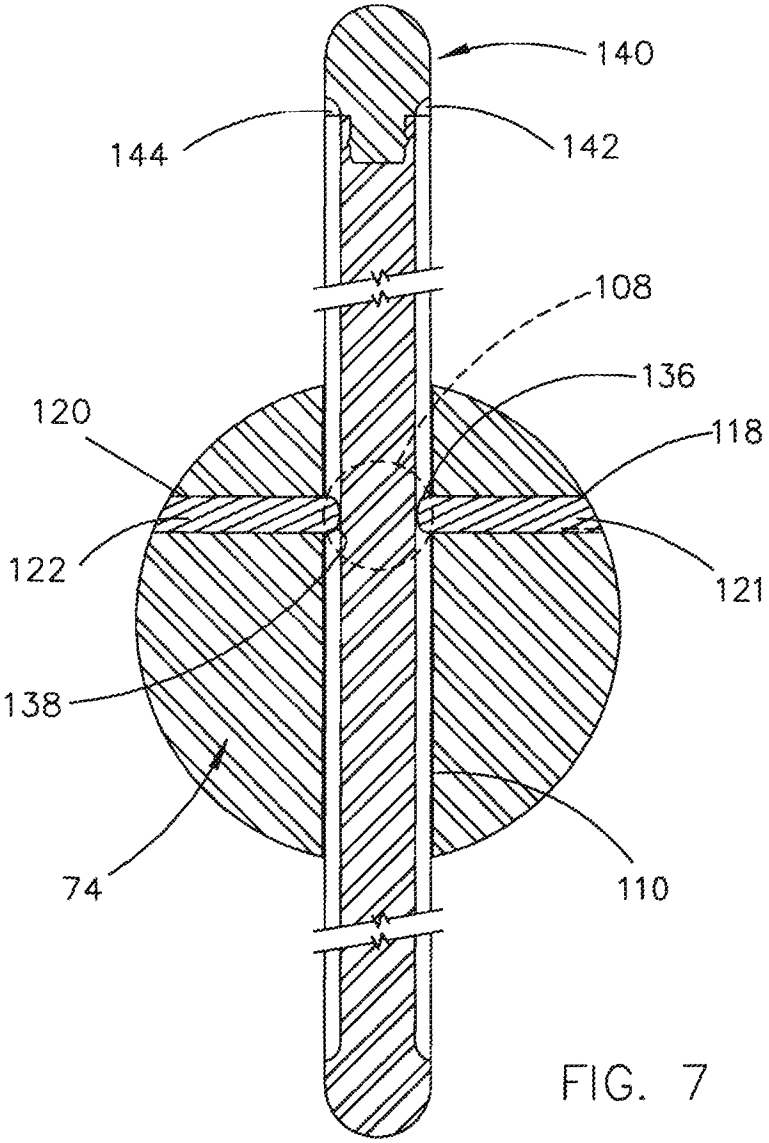
FIG. 7 is a sectional view similar to FIG. 6 except that the associated lever thereof is in an extended grasping position.
Figure 6:
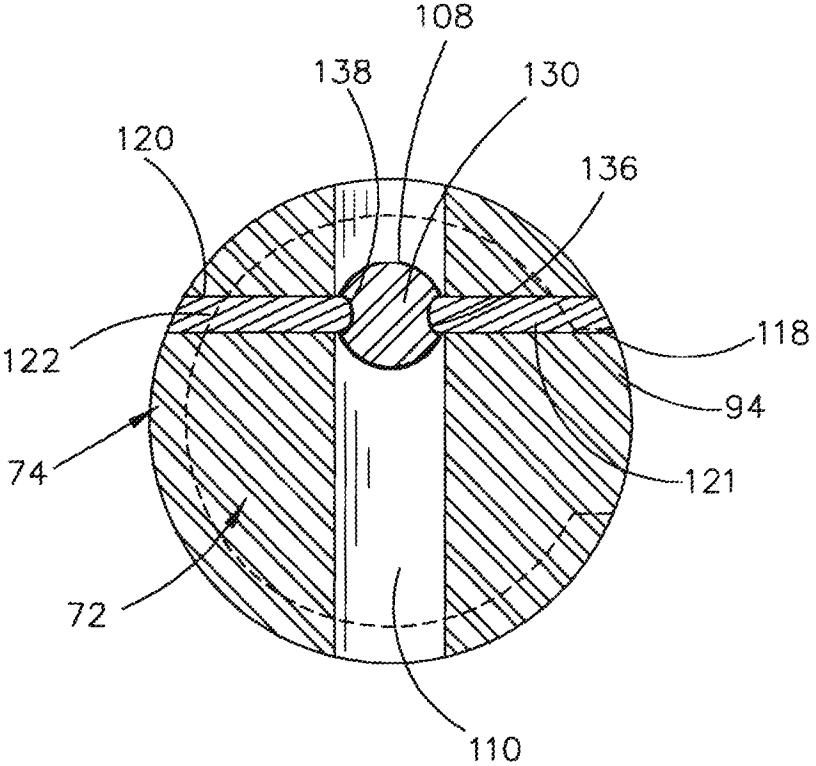
FIG. 6 is a sectional view of the first end cap assembly of this invention with the associated lever thereof being in a stowed position.
Figure 8:
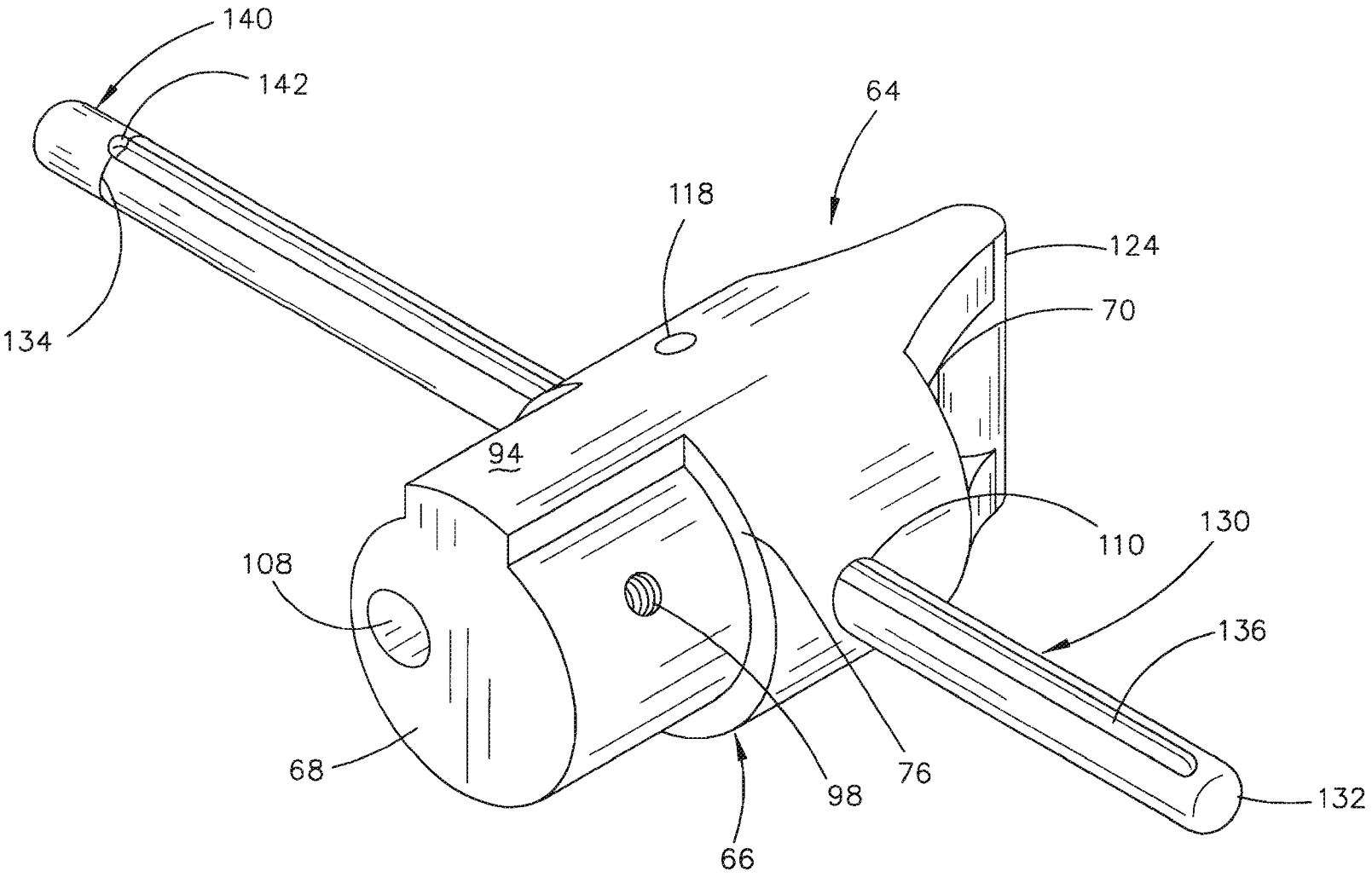
FIG. 8 is an inner perspective view of the first end cap assembly of this invention with the lever thereof being in the transverse grasping position.
Figure 9:
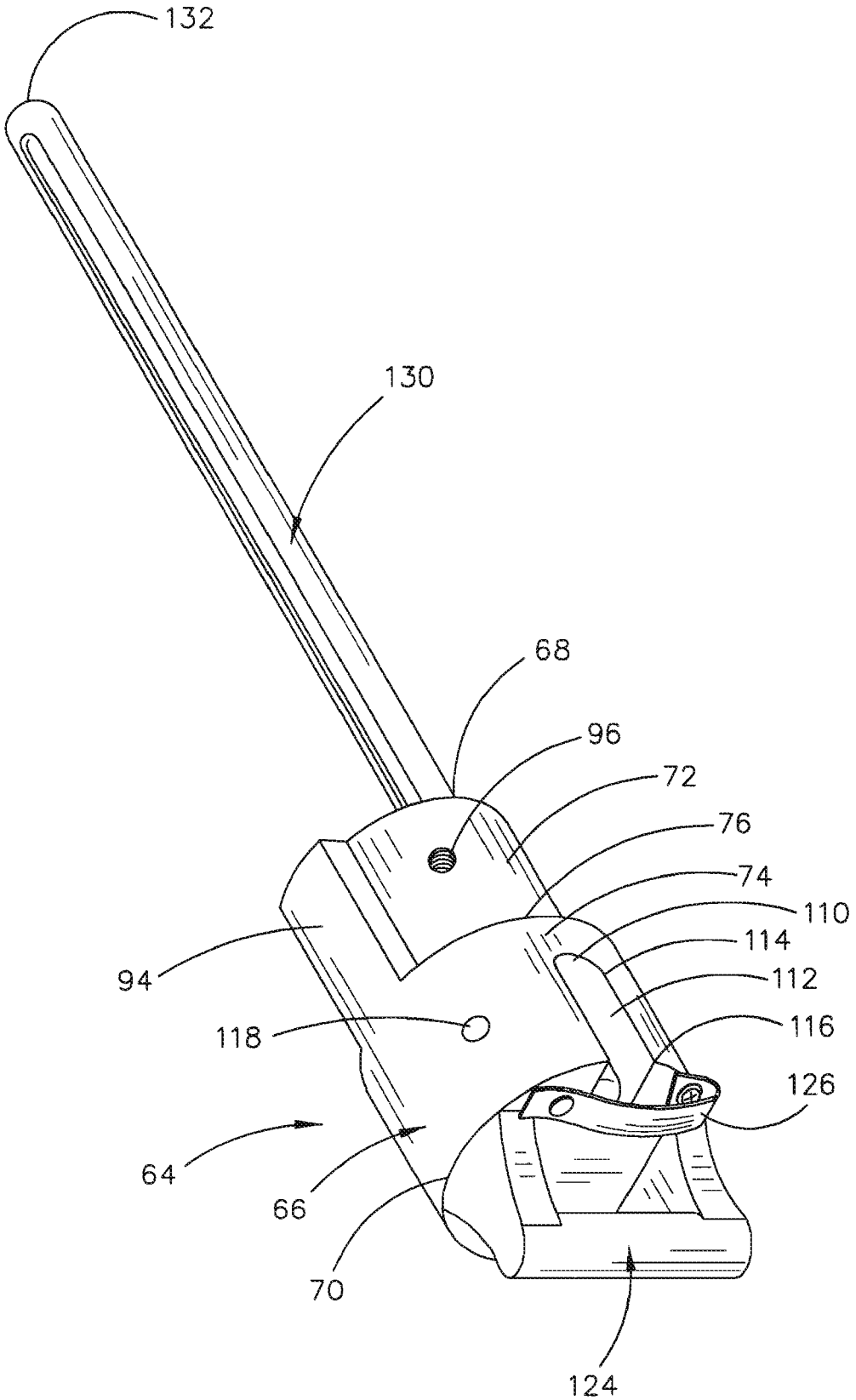
FIG. 9 is an outer perspective view of the end cap assembly of FIG. 8 with the associated lever being in its stowed position.
Figure 10:
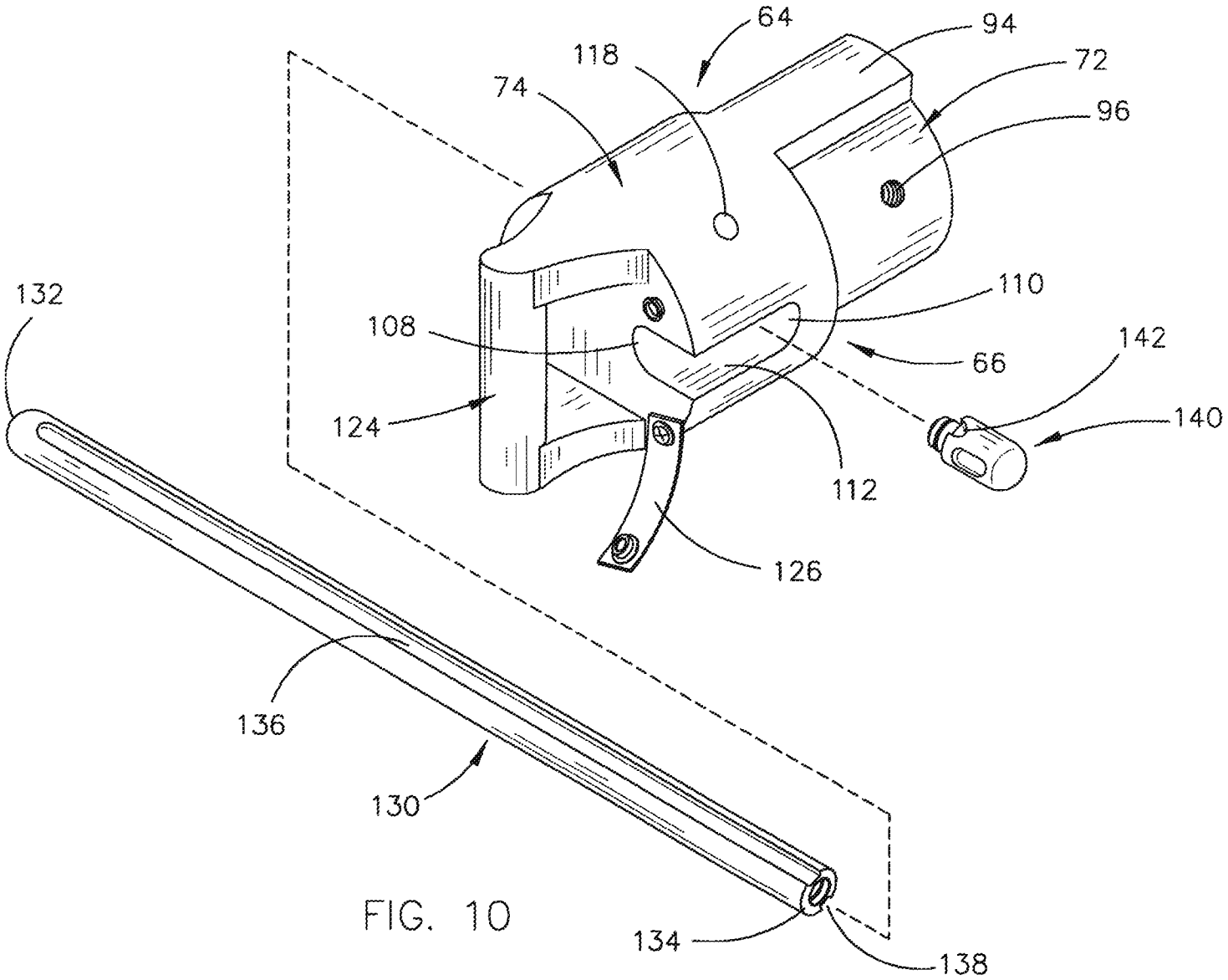
FIG. 10 is an outer exploded perspective view of the end cap assembly of FIG. 8 which illustrates that the associated lever having a removable cap at one end to permit the lever thereof to be inserted into the body member of the device of this invention.

When the lever 130 is in the position of FIG. 5, the ends of the lever 130 may be grasped or gripped to roll-up or unroll the mat 12. When it is desired to stow the lever 130, the lever 130 is slidably moved in the bore 110 until the ends of the grooves 134 and 136 are positioned at the pins 121 and 122. The lever 130 is then pivotally moved from the transverse grasping position to a horizontal position where the lever 130 rests upon the lower end of bore 108 at the outer end of body member 66. The lever 130 is then horizontally slidably moved inwardly into body member 66 until the ends of the grooves 142 and 144 of cap 140 abut the pins 121 and 122 respectively thereby limiting the inward movement of lever 130. The strap 126 is then fastened to maintain the lever 130 in its stowed position.

The numeral 64' refers to the end cap assembly at the second end of the cylinder 26. The only difference between end cap assembly 64' and end cap assembly 64 is that the positioning member or guide 94' is positioned on the opposite side of body member 66' from that shown on end cap assembly 64. Accordingly, identical structure on end cap assembly 64' will be identified with ' "

In summary, the inner end 14 of the mat 12 is secured to the mat retainer 36 by the bolts 60. The inner end of the mat 12 and the mat retainer 36 are inserted into the cylinder 26 as described above. The end cap assemblies 64 and 64' are then inserted into the cylinder 26 and secured thereto as will be described hereinafter. The end cap assembly 64 is secured to end 28 of cylinder 26 as will now be described. The body member 66 will be rotated so that the positioning member 94 is aligned with the slot 34 at the end 28 of cylinder 26. The body member 66 is then moved towards the end 28 of cylinder 26 so that the inner end portion 72 of body member 66 is inserted into the end 28 of cylinder 26 with the positioning member 94 being received in slot 34 until shoulder 76 abuts the end 28 of cylinder 26. The abutment of shoulder 76 with the end 28 of cylinder 26 and the positioning member 94 being inserted into slot 34 causes the bolt openings 94 and 96 of inner end portion 72 to register with bolt openings 100 and 102 of cylinder 26. The bolts 104 and 106 are then inserted into openings 100 and 102 respectively and then are threadably secured to bolt openings 94 and 96 respectively. The end cap assembly 64' is then secured to end 30 of cylinder 26 in the same manner as end cap assembly 64 is secured to end 28 of cylinder 26. The levers 130 and 130' will be positioned in the grasping position and are then grasped by the persons who are going to roll-up the mat 12 onto the cylinder 26. Once the mat 12 is rolled-up, a rope or string will be extended around the rolled-up mat to maintain the mat 12 in the rolled-up position. The rolled-up mat 12 may then be carried from location to another by a person or persons grasping the handles 124 and 124'. When it is desired to unroll the mat, the outer end of the mat 12 is grasped and pulled outwardly from the cylinder 26.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A device for rolling up and unrolling a floating mat having a first end, a second end, a first side, a second side, an upper surface and a bottom surface, comprising:

an elongated hollow cylinder having a first end, a second end, and an outer surface;

said cylinder having an elongated slot, having first and second ends, formed in said outer surface thereof which extends between said first and second ends of said cylinder;

an elongated mat retainer having a first end and a second end;

said mat retainer being configured to have the first end of the floating mat secured thereto;

said mat retainer and the first end of the floating mat being positioned in said cylinder by slidably extending said mat retainer and the first end of the floating mat into one of said first and second ends of said cylinder with the floating mat extending outwardly through said slot in said cylinder;

a first end cap assembly secured to said first end of said cylinder;

said first end cap assembly having an inner end and an outer end;

a second end cap assembly secured to said second end of said cylinder;

said second end cap assembly having an inner end and an outer end;

an elongated first lever, having first and second ends, being selectively movably secured to said first end cap assembly between a first position wherein said first lever is transversely disposed with respect to said first end of said cylinder and a second stowed position wherein said first lever is positioned in said first end cap assembly and said first end of said cylinder; and an elongated second lever, having first and second ends, being selectively movably secured to said second end cap assembly between a first position wherein said second lever is transversely disposed with respect to said second end of said cylinder and a second stowed position wherein said second lever is positioned in said second end cap assembly and said second end of said cylinder.

2. The device of claim 1 wherein each of said first and second end cap assemblies have inner end portions which are inserted into and secured to said first and second ends of said cylinder respectively.

3. The device of claim 2 wherein each of said inner end portions of each of said first and second end cap assemblies have a positioning insert thereon which is received in said first and second ends of said elongated slot respectively.

4. The device of claim 1 wherein said first and second levers are selectively slidably and pivotally secured to said first and second end cap assemblies respectively.

5. The device of claim 1 wherein each of said first and second levers have a cap selectively secured to one end whereby said first and second levers may be inserted into said first and second end cap assemblies upon the removal of said caps from said levers.

6. The device of claim 1 wherein each of said first end cap assembly and said second end cap assembly has a handle at said outer end thereof.

7. A device for rolling up and unrolling a floating mat having a first end, a second end, a first side, a second side, an upper surface and a bottom surface, comprising:

an elongated hollow cylinder having a first end, a second end, and an outer surface;

said cylinder having an elongated slot, having first and second ends, formed in said outer surface thereof which extends between said first and second ends of said cylinder;

an elongated mat retainer having a first end and a second end;

said mat retainer being configured to have the first end of the floating mat secured thereto;

said mat retainer and the first end of the floating mat being positioned in said cylinder by slidably extending said mat retainer and the first end of the floating mat into one of said first and second ends of said cylinder with the floating mat extending outwardly through said slot in said cylinder;

a first end cap assembly secured to said first end of said cylinder;

said first end cap assembly having an inner end and an outer end;

a second end cap assembly secured to said second end of said cylinder;

said second end cap assembly having an inner end and an outer end;

each of said first end cap assembly and said second end cap assembly including:

(a) a horizontally disposed body member having an inner end, an outer end, an upper end, a lower end, a first side, a second side and a central axis;

(b) an elongated and horizontally disposed bore formed in said body member which extends from said outer end of said body member to said inner end of said body member;

(c) said elongated and horizontally disposed bore having an inner end and an outer end;

(d) said elongated and horizontally disposed bore being offset above said central axis of said body member;

(e) a vertically disposed bore which extends between said upper end of said body member and said lower end of said body member;

(f) said vertically disposed bore having an upper end and a lower end;

(g) said vertically disposed bore intersecting said elongated and horizontally disposed bore between said inner end and said outer end of elongated and horizontally disposed bore so as to be in communication therewith;

(h) a slot formed therein in said body member at said outer end of said outer end of said body member which extends downwardly into said upper end of said body member;

(i) said slot having an inner end, an outer end, an upper end and a lower end;

(j) said lower end of said slot communicating with said elongated and horizontally disposed bore;

(k) said inner end of said slot also communicating with said vertically disposed bore;

(l) an elongated first pin having an inner end and an outer end;

(m) said first pin extending inwardly into said first side of said body member whereby said inner end of said first pin protrudes into said elongated and horizontally disposed bore and said vertically disposed bore;

(n) an elongated second pin having an inner end and an outer end;

(o) said second pin extending inwardly into said second side of said body member whereby said inner end of said second pin protrudes into said elongated and horizontally disposed bore and said vertically disposed bore;

(p) said inner ends of said first and second pins being oppositely disposed and being spaced-apart;

(q) an elongated and cylindrical first lever, having a first end, a second end, a first side and a second side;

(r) said first side of said first lever having an elongated first groove formed therein which has a first end and a second end;

(s) said first end of said first groove being spaced from said first end of said first lever;

(t) said second end of said first groove being spaced from said second end of said first lever;

(u) said second side of said first lever having an elongated second groove formed therein which has a first end and a second end;

(v) said second side of said first lever having an elongated second groove formed therein which has a first end and a second end;

(w) said first end of said second groove being spaced from said first end of said first lever;

(x) said second end of said second groove being spaced from said second end of said first lever;

(y) said first lever being selectively positioned in a first grasping position and a second stowed position with respect to said body member; and (z) said first lever, when in said first grasping position, being selectively movably positioned in said vertically disposed bore in a transverse position with respect to said body member and wherein said inner end of said first pin is received in said first groove in said first lever and wherein said inner end of said second pin is received in said second groove in said first lever.

8. The device of claim 7 wherein each of said first end cap assembly and said second end cap assembly has a handle at the outer end of the respective body member.

9. A device for rolling up and unrolling a floating mat having a first end, a second end, a first side, a second side, an upper surface and a bottom surface, comprising:

an elongated hollow cylinder having a first end, a second end, and an outer surface;

said cylinder having an elongated slot, having first and second ends, formed in said outer surface thereof which extends between said first and second ends of said cylinder;

an elongated mat retainer having a first end and a second end;

said mat retainer being configured to have the first end of the floating mat secured thereto;

said mat retainer and the first end of the floating mat being positioned in said cylinder by slidably extending said mat retainer and the first end of the floating mat into one of said first and second ends of said cylinder with the floating mat extending outwardly through said slot in said cylinder;

a first end cap assembly secured to said first end of said cylinder;

said first end cap assembly having an inner end and an outer end;

a second end cap assembly secured to said second end of said cylinder;

said second end cap assembly having an inner end and an outer end;

a first handle positioned at said outer end of said first end cap assembly; and a second handle positioned at said outer end of said second end cap assembly.

10. The device of claim 9 wherein each of said first end cap assembly and said second end cap assembly have an elongated lever which is slidably and pivotally secured thereto with each of said levers being selectively moveable between a grasping position and a stowed position.

11. The device of claim 10 wherein said levers extend transversely from said end cap assemblies when said levers are in said grasping position and with said levers being positioned in said respective end cap assembly and said cylinder when in said stowed position.

* * * * *